United States Patent [19]

Carey et al.

[11] Patent Number: 4,917,737

[45] Date of Patent: Apr. 17, 1990

[54] SEALING COMPOSITION AND METHOD FOR IRON AND ZINC PHOSPHATING PROCESS

[75] Inventors: William S. Carey, Ridley Park; David W. Reichgott, Richboro, both of Pa.

[73] Assignee: Betz Laboratories, Inc., Trevose, Pa.

[21] Appl. No.: 322,447

[22] Filed: Mar. 13, 1989

[51] Int. Cl.[4] ..... C23C 22/84

[52] U.S. Cl. ..... 148/250; 148/255

[58] Field of Search ..... 148/250, 255, 257

[56] References Cited

U.S. PATENT DOCUMENTS

| | | | |
|---|---|---|---|
| 4,000,012 | 12/1976 | Burrows | 148/255 |
| 4,437,898 | 3/1984 | Drosdziok | 148/250 |
| 4,678,519 | 7/1987 | Schapira | 148/255 |

*Primary Examiner*—Sam Silverberg

*Attorney, Agent, or Firm*—Alexander D. Ricci; Steven D. Boyd

[57] ABSTRACT

Method and composition for sealing of a phosphate conversion coating is disclosed. The method includes contacting a phosphate conversion coating with an acidic aqueous solution of substituted iminodimethylene diphosphonic acids represented, as a class, by the formula $R1—N—(CH_2—PO_3H_2)_2$ where R1 is a Z, alkyl or aryl moiety having a carbon chain up to the length where solubility in an acidic aqueous solution is lost. Z is $$[Cn—\overset{\overset{R2}{|}}{N}]_m—R3$$

where R2 and R3 are hydrogen, alkyl, aryl, or phosphono alkyl moieties, m is from 1 to 3 and Cn is a methylene carbon chain up to the length where solubility in an acidic aqueous solution is lost, and water soluble salts thereof. Preferably, R1 is methyl through octyl, benzyl, or diethylenediaminotrimethylene triphosphonic acid. The substituted iminodimethylene diphosphonic acid is applied as an aqueous bath with a pH of from about 3.3 to 4.0. The substituted iminodimethylene diphosphonic acid may dry in place or be followed by a deionized water rinse.

7 Claims, No Drawings

SEALING COMPOSITION AND METHOD FOR IRON AND ZINC PHOSPHATING PROCESS

FIELD OF THE INVENTION

The present invention relates to a composition and method for sealing a conversion coating on a metal substrate. More particularly, the present invention relates to a heavy metal free, post-treatment sealing rinse for an iron or zinc phosphate process.

BACKGROUND OF THE INVENTION

The use of conversion coatings for the purpose of inhibiting corrosion of a metal substrate is well known. Phosphating is a widely used form of metal pretreatment. While phosphate coatings inhibit the corrosion of the metal substrate, the porosity of a phosphate coating results in only a limited measure of protection. For this reason, a phosphatizing process is often followed by a separate rinse process in order to provide for sealing of the pores of the phosphate coating. Chromic acid based solutions have often been used as such sealing rinses for phosphate coatings in the prior art. While chromic acid solutions as sealers are effective, due to the toxicity of the chromic acid solution waste disposal is difficult. Also, the strongly corrosive nature of a chromic acid solution complicates the storage, handling, and use of such solutions.

Sealants for phosphatized metal substrates which avoid the use of chromic acid are known in the art. For example, U.S. Pat. No. 3,196,039, Herbst et al, discloses a process and solution for sealing a phosphate coating on a metal surface. The solution contains a polyvinyl phosphonic acid and/or copolymers of vinyl phosphonic acid and/or acid derivatives thereof which contain, per monomer unit, only one free hydroxyl group at the phosphorus atom. Suitable components for the copolymer include mono or polyunsaturated organic compounds having a substantially polar character such as acrylic acid, methacrylic acid and the esters of aliphatic alcohols thereof, the amides and nitriles thereof, also vinyl esters such as vinyl acetate and vinyl propionate, maleic acid anhydride and crotonic acid. After treatment with the sealing solution, the metal parts are heated to from 80° C to 180° C to dry.

U.S. Pat. No. 4,220,485, Howell et al discloses a composition for sealing of phosphatized metal components which consists of a phosphoric acid, a zinc compound, a heavy metal accelerator and/or crystal refiner and a phosphonate corrosion inhibitor. While the sealant composition of Howell et al avoids he use of chromic acid, the inclusion of a heavy metal accelerator such as vanadium, titanium, zirconium, tungsten and molybdenum raises concerns regarding disposal of waste products. The composition disclosed in Howell et al includes a phosphonate as a corrosion inhibitor.

The use of a phosphonate as a corrosion inhibitor is known in the art. U.S. Pat. No. 4,501,667, Cook, discloses a corrosion control solution and process to inhibit the scale deposition from aqueous systems which comprises adding a 2-amino-phosphonoacetic acid compound to an aqueous system in contact with metal surfaces and as a preconditioner for metal surfaces prior to contact with a corrosive environment. In completely aqueous systems, such as cooling water systems, the Cook disclosure notes that further corrosion inhibitors can be added which may include methylamino- dimethylene-phosphonic acid employed in combination with the 2-amino-phosphonoacetic acid compound described. In the totally aqueous system described in Cook, the corrosion inhibiting additives are in continuous solution contact with the surface which is being treated.

U.S. Pat. No. 4,517,028, Lindert, discloses a treatment for metal surfaces which comprises contacting the surface with a polymer which is based on derivatives of poly-alkenylphenol polymer.

The use of a phosphonic acid complexed with a divalent metal in an aqueous solution for hot water or steam sealing of anodically produced oxide layers on aluminum is disclosed in U.S. Pat. No. 3,900,370, Germscheid et al. In the Germscheid patent the use of an aqueous solution of phosphonic acid in combination with calcium ions at a pH of from 5 to 6.5 as a sealant for an anodically produced oxide layer on aluminum is disclosed. The high temperature conditions disclosed for sealing of the electrolytic, anodic coating are not necessary in the practice of the present invention.

The advantages to be gained through the use of sealers to improve the corrosion resistance of conversion coatings has been recognized, as has the objectionable properties of typical chromium compounds employed as a sealer. The most commonly described non-chromium sealers, based upon amines, tannins, aminoalkylated polyvinylphenol and heavy metals have not earned wide acceptance, principally due to disappointing performance in retarding corrosion. Furthermore, some of the heavy metal based sealers may pose significant waste disposal problems.

SUMMARY OF THE INVENTION

The present invention provides an effective method and composition for sealing of a phosphate conversion coating. The method and composition of the present invention does not employ chromium and/or heavy metals, thus avoiding the toxicity, handling and disposal problems of typical prior art sealer compositions. The composition of the present invention comprises an acidic aqueous solution of substituted iminodimethylene diphosphonic acids represented, as a class, by the formula $R1\text{-}N\text{-}(CH_2\text{—}PO_3H_2)_2$ where R1 is a Z, alkyl or aryl moiety having a carbon chain up to the length where solubility in an acidic aqueous solution is lost. Z is $$[Cn-\overset{\overset{R2}{|}}{N}]_m-R3$$

where R2 and R3 are hydrogen, alkyl, aryl, or phosphono alkyl moieties, m is from 1 to 3 and Cn is a methylene carbon chain up to the length where solubility in an acidic aqueous solution is lost, and water soluble salts thereof. Preferably, R1 is methyl through octyl, cyclohexyl, benzyl or diethylenediaminotrimethylene triphosphonic acid. The substituted iminodimethylene diphosphonic acid of the present invention provides an effective post treatment rinse for an iron or zinc phosphate process as used in the treatment of steel, galvanized steel and aluminum surfaces. The composition of the present invention is applied to a phosphatized surface and dried in place thereby improving the corrosion resistance of the phosphate coating. The substituted iminodimethylene diphosphonic acid is applied as an aqueous bath and dried. A deionized water rinse may be employed or the coating may be dried without rinsing. The aqueous bath including the composition of the present invention preferably has a pH in the range of about 3 to about 7 and most preferably has a pH of about 3.5.

DETAILED DESCRIPTION OF THE PREFERRED EMBODIMENTS

In accordance with the present invention, a postphosphatizing rinse is provided which comprises an aqueous solution of substituted iminodimethylene diphosphonic acid. The iminodimethylene diphosphonic acids useful in the practice of the present invention are represented by the formula $R1\text{-}N\text{-}(CH_2\text{—}PO_3H_2)_2$ where R1 is a Z, alkyl or aryl moiety having a carbon chain up to the length where solubility in an acidic aqueous solution is lost. Z is $$[Cn\text{—}\overset{\overset{R2}{|}}{N}]_m R3$$

where R2 and R3 are hydrogen, alkyl, aryl, or phosphono alkyl moieties, m is from 1 to 3 and Cn is a methylene carbon chain up to the length where solubility in an acidic aqueous solution is lost, and water soluble salts thereof. Preferred materials for R1 include methyl ($\text{—}CH_3$) through octyl. ($\text{—}C_8H_7$), cyclohexyl, benzyl and diethylenediaminotrimethylenetriphosphonic acid $$\text{—}CH_2\text{—}CH_2\text{—}\underset{\underset{CH_2\text{—}PO_3H_2}{|}}{N}\text{—}CH_2\text{—}CH_2\text{—}N\text{—}(CH_2\text{—}PO_3H_2)_2$$

The resulting substituted iminodimethylene diphosphonic acids have been found to provide improved sealing of a phosphate conversion coating when applied as a post-phosphatized rinse. The sealer of the present invention improves the corrosion protection provided by a phosphate conversion coating without instigating the problems of toxicity and disposal inherent in prior art sealing processes. The post-phosphatizing sealer of the present invention is applied as a one time application. The sealer may be applied in any suitable manner such as by spraying or immersion processes. Typical processes for application of the sealer include a three stage process comprising a cleaning and phosphatizing step, a water rinse step and the sealer step. Alternatively, a five stage process comprising an acid or alkaline cleaning step, a water rinse step, a phosphatizing step, an additional water rinse followed by the sealer may be employed. The sealer step is typically carried out at temperatures of from about 60° F. to about 180° F. and the contact times range from about 5 to about 120 seconds. The sealer pH can range from about 3 to about 7 with a preferred pH of about 3.5.

The substituted iminodimethylene diphosphonic acids of the present invention, comprise aqueous acidic solutions. As a class they are represented by the formula $R1\text{—}N\text{—}(CH_2\text{—}PO_3H_2)_2$ where R1 is a Z, alkyl or aryl moiety having a carbon chain up to the length where solubility in an acidic aqueous solution is lost. Z is

| Material | Percent by Weight Based on Dry Composite |
|---|---|
| Slag | 17 |
| Flyash | 75 |
| Cement and lime | 7 |

-continued

| Material | Percent by Weight Based on Dry Composite |
|---|---|
| Bentonite clay | 1 |
| Initial Water | 25 |
| Final Free Moisture, after normal drying | 6 |

where R2 and R3 are hydrogen, alkyl, aryl, or phosphono alkyl moieties, m is from 1 to 3 and Cn is a methylene carbon chain up to the length where solubility in an acidic aqueous solution is lost, and water soluble salts thereof. R1 may be $C_1$ to $C_8$, or higher, up to the point where solubility in acidic aqueous solutions is lost. R1 = hexyl or benzyl is preferred. R1 = hexyl is the most preferred due to the somewhat lower solubility of the benzyl moiety. When the R1 is $CH_3$ the result is N-methyliminodi-methylene diphosphonic acid. When the R1 is $CH_2\text{—}C_6H_5$ the result is N-benzyl iminodimethylenediphosphonic acid and when the R1 is $$\text{—}CH_2\text{—}CH_2\text{—}\underset{\underset{CH_2\text{—}PO_3H_2}{|}}{N}\text{—}CH_2\text{—}CH_2\text{—}N\text{—}(CH_2\text{—}PO_3H_2)_2$$

the result is diethylenetriiminopentamethylene pentaphosphonic acid (DTPMPA). DTPMPA is commercially available as a 50% aqueous solution, for example as Dequest 2060 from the Monsanto Corporation. The former materials, while known in the scientific literature are presently unavailable commercially. Examples 1 and 2 hereinbelow, outline the preparation of these materials by a procedure similar to that described by K. Moedritzer et al, The Journal of Organic Chemistry, Volume 31, pages 1603 to 1607 (1966). Similar procedures can be employed to prepare other iminodimethylene diphosphonic acids useful in accordance with the present invention.

| Material | Percent by Weight Based on Dry Composite |
|---|---|
| Slag | 37 |
| Flyash | 50 |
| Cement | 12 |
| Bentonite clay | 1 |
| Initial water | 50 |
| Final Free Moisture, after normal drying | 3 |

EXAMPLE 1:

Preparation of N-Methyliminodimethylene diphosphonic Acid

To a 500 milliliter reactor was charged 17 milliliters of deionized water, 41.8 grams of phosphorus acid, 50 milliliters of 37% aqueous hydrochloric acid and 19.4 grams of 40% aqueous methyl amine. The reactor contents were heated to a slight reflux and 81.16 grams of 37% aqueous formaldehyde was added over a period of 135 minutes. Thereafter, the reactor was heated at a slight reflux for 2 hours. The mixture was then concentrated under vacuum to yield 187.3 grams of a clear colorless liquid. Upon treatment with 100 milliliters of denatured ethanol a white precipitate resulted which was collected via filtration, washed with an additional 200 milliliters of denatured ethanol, refiltered, and dried in vacuum to yield 50.5 grams of N-methyliminodimethylene diphosphonic acid.

EXAMPLE 2:

Preparation of N-Benzyliminodimethylene diphosphonic Acid

To a 500 milliliter reactor was charged 55 milliliters of deionized water, 41.8 grams of phosphorous acid, 75 milliliters of 37% aqueous hydrochloric acid and 27.06 grams of benzylamine. The reactor contents were heated to a slight reflux and 81.16 grams of 37% aqueous formaldehyde was added over a 145 minute period. Thereafter, the mixture was held at a slight reflux for 2 hours, during which time the mixture became a fluid white slurry. The mixture was concentrated under a vacuum to yield 74.09 grams of a moist white precipitate which upon treatment with 110.3 grams of 9.2% aqueous sodium hydroxide resulted in an aqueous solution of N-benzyliminodimethylene diphosphonic acid sodium salt.

The results summarized in the following examples demonstrate the efficacy of the sealer of the present invention when compared to prior art sealer solutions in standard adhesion and corrosion tests.

EXAMPLE 3

Cold rolled steel test panels were cleaned in a commercial spray cleaner solution and rinsed in tap water. A commercial titanated phosphate activator solution was applied by immersing the test panels for 20 seconds. A zinc phosphate conversion coating was then applied in a one minute spray treatment with a solution comprising 1.7% by volume Permatreat 400, a nickel-catalyzed zinc phosphate available from Betz Laboratories, Inc., Trevose, PA, in tap water at 130° F. The pH was adjusted to the range of 3.3 to 3.6 and sodium nitrite was added to give a concentration of about 0.18 grams per liter as $NO_2$.

After formation of the conversion coating, the test panels were rinsed in tap water and the sealer solution applied by immersion for about 7 seconds at about 110° F. The sealer solutions were prepared by dissolving 0.15 to 0.20 g/l of the substituted iminodimethylene diphosphonic acids in tap water, adding a molar equivalent weight of sodium hydroxide, thus forming a solution comprising the monosodium salt. Optionally, ammonium hydroxide may be used. The solution pH was adjusted to the range of 3.4 to 3.6 with phosphoric acid. Optionally, other acids such as fluotitanic or fluozirconic acid may be used. The test panels were then dried, without rinsing, in a stream of warm air. The test panels were stored in a desiccator prior to being painted with a baked on enamel (PPG white Polycron II).

The painted test panels were subjected to adhesion and corrosion test methods which would be familiar to a person skilled in the art. The test methods included direct and reverse impact (round punch), mandrel bend (conical mandrel approximately 2 to 50 millimeters in diameter) and a neutral salt fog test which employed a spray mist of 5% NaCl for 144 hours with creepback rated according to ASTM D-1654 Procedure A, Method 2. Table I summarizes the results of Example 3.

TABLE I

Performance Data for Iminodimethylene Diphosphonic Acids
Zinc Phosphate Process on Cold Rolled Steel

| Material (R-X) or Comparative Example | Direct Impact inch-lb passed | Reverse Impact inch-lb passed | Conical Mandrel Bend mm loss | 144 hr Salt-Fog ASTM D-1654 Rating |
|---|---|---|---|---|
| R = $C_7H_{20}N_2O_9P_3$ | 112 | 22 | 16 | 6.4 |
| R = methyl | 130 | 20 | 15 | 6.5 |
| R = n-butyl | 160 | 20 | 16 | 6.8 |
| R = n-hexyl | 137 | 18 | 21 | 7.2 |
| R = cyclohexyl | 140 | 10 | 14 | 6.5 |
| R = benzyl | 130 | 20 | 14 | 7.0 |
| R = n-octyl | 160 | 10 | 10 | 6.8 |
| Ex. A | 150 | 15 | 9 | 2.5 |
| Ex. B | 105 | 20 | 17 | 6.0 |
| Ex. C | 110 | 14 | 17 | 7.5 |
| Ex. D | 136 | 28 | 13 | 9.8 |

Notes:
X = —N—$(CH_2PO_3H_2)_2$
R = $C_7H_{20}N_2O_9P_3$ for R-X = "DTPMPA"
Ex. A: 1.0 g/l monoethanolamine + phosphoric acid to pH = 3.5 to 3.8.
Ex. B: aminoalkylated poly(vinylphenol), (final rinse no. 3, Example 5, U.S. Pat. No. 4,517,028)
Ex. C: 0.15-0.20 g/l poly(vinylphosphonic acid).
Ex. D: 1.0 g/l as $CrO_3$ + $NH_4OH$ to pH = 3.9
All data are averages of multiple determinations.

EXAMPLE 4

Cold rolled steel panels were treated by spraying with a surfactant containing solution of monosodium phosphate in tap water at 125° F. for one minute. The solution was adjusted to a pH of about 5.1 and sufficient phosphate added to give a titration of about 4 to 5 milliliters of 0.1 normal NaOH on a 10 milliliter sample to the phenolphthalein end point. The treatment solution also contained about 300 parts per million sodium m-nitrobenzene sulfonate. After treatment, the test panels were rinsed in warm tap water and immersed in the sealer at about 110° F. for about 7 seconds. The panels were then dried and painted as described above in Example 3. The results of a series of tests for different sealer solutions is summarized in Table II. (Note the duration of the salt fog test was reduced to 72 hours in this example.)

TABLE II

Performance Data for Iminodimethylene Diphosphonic Acids
Iron Phosphate Process on Cold Rolled Steel

| Material (R-X) or Comparative Example | Direct Impact inch-lb passed | Reverse Impact inch-lb passed | Conical Mandrel Bend mm loss | 2 hr Salt-Fog ASTM D-1654 Rating |
|---|---|---|---|---|
| R = $C_7H_{20}N_2O_9P_3$ | 151 | 31 | 7 | 6.7 |
| R = methyl | 150 | 20 | 1 | 7.3 |
| R = n-butyl | 160 | 40 | 4 | 7.3 |
| R = n-hexyl | 158 | 45 | 5 | 7.5 |
| R = cyclohexyl | 160 | 60 | 4 | 7.0 |
| R = benzyl | 160 | 50 | 2 | 7.6 |
| R = n-octyl | 160 | 80 | 3 | 7.3 |
| Ex. A | 160 | 40 | 10 | 4.0 |
| Ex. B | 160 | 64 | 2 | 4.3 |
| Ex. C | 160 | 54 | 3 | 7.8 |
| Ex. D | 140 | 38 | 7 | 9.9 |

Notes: See Table I.

EXAMPLE 5

The same treatment sequence was followed as in Example 3, except that 0.23 grams per liter of ammonium fluoride was added and the test panels were 3003 alloy aluminum. In addition to neutral salt fog, the painted test panels were exposed to deionized water for 24 hours at 100° F. After removal from the water, the surface was scribed with two perpendicular sets of parallel lines at about 2 millimeter spacing, tape was applied to the cross-hatch area and pulled off, and the degree of paint removal was rated in accordance with ASTM D-3359 (5B equals no paint removed, OB equals near total removal). Another set of water soaked panels had an X scribe cut through the paint prior to immersion., after removal, the area included by the scribe was scraped and the percent of the area that lost paint was estimated. Table 111 summarizes the results obtained with aluminum 3003 alloy.

TABLE III

Performance Data for Iminodimethylene Disphosphonic Acids Zinc Phosphate Process on 3003 Alloy Aluminum

| Material (R-X) or Comparative Example | Reverse Impact inch-lb passed | 144 Hour Salt-Fog ASTM D-1654 Rating | 24 Hour Deionized Water Soak Cross Hatch ASTM D-3359 | 24 Hour Deionized Water Soak Scribe (% of area lost) |
|---|---|---|---|---|
| R = $C_7H_{20}N_2O_9P_3$ | 12 | 9.5 | 2B | 5 |
| R = methyl | 6 | 9 | 0B | 10 |
| R = n-hexyl | 8 | 9.5 | 4B | 10 |
| Ex. B | 8 | 9.5 | 0B | 100 |
| Ex. C | 16 | 10 | 4B | 2 |

Notes: See Table I.

The results set forth in Tables 1 through 3 demonstrate the improved efficacy of the sealer of the present invention. Although the present invention has been described with respect to particular embodiments thereof, it is apparent that numerous other forms and modifications of this invention will be obvious to those skilled in the art. Those skilled in the art will recognize that slightly different application techniques could be used to enhance overall paint and sealer performance. Such techniques include, but are not limited to use of deionized water to make up the sealer baths, use of a pure deionized water rinse after the sealer but before drying, use of multicoat paint systems, use of an electrocoat primer, etc. The appended claims and this invention generally should be considered to cover all such obvious forms and modifications which are within the true spirit and scope of the present invention.

What is claimed is:

1. A method of sealing a phosphatized metal component which comprises contacting a phosphatized metal component with a heavy metal and chromium free aqueous acidic solution consisting essentially of a substituted iminodimethylene diphosphonic acid having the formula $R1—N—(CH_2—PO_3H_2)_2$ wherein R1 is a Z, alkyl or aryl moiety having a carbon chain length up to a length where solubility in an acidic aqueous solution is lost; where Z is $$[Cn—\overset{\overset{R2}{|}}{N}]_m R3$$

R2 and R3 are hydrogen, alkyl, aryl or phosphono alkyl moieties, m is 1 to 3, and Cn is a methylene carbon chain up to the length where solubility in an acidic aqueous solution is lost, and water soluble salts thereof.

2. The method of claim 1 wherein R is $—CH_3$ through $—C_8H_{17}$, $—C_6H_{11}$, $—CH_2—C_6H_5$ or $$—CH_2—CH_2—\underset{\underset{CH_2—PO_3H_2}{|}}{N}—CH_2—CH_2—N—(CH_2—PO_3H_2)_2.$$

3. The method of claim 1 wherein said aqueous solution containing substituted iminodimethylene diphosphonic acid has a pH of from about 3 to about 7.

4. The method of claim 3 wherein said aqueous solution has a pH from about 3.3 to about 4.0.

5. The method of claim 3 wherein the pH is adjusted by the addition of a component selected from the group consisting of NaOH, $NH_4OH$, $H_3PO_4$, $H_2ZrF_6$ and $H_2TiF_6$.

6. The method of claim 1 wherein said substituted iminodimethylene diphosphonic acid is dried in place.

7. The method of claim 1 wherein said contacting is followed by a water rinse.

* * * * *

UNITED STATES PATENT AND TRADEMARK OFFICE

CERTIFICATE OF CORRECTION

PATENT NO. : 4,917,737

DATED : April 17, 1990

INVENTOR(S) : Carey et al

It is certified that error appears in the above-identified patent and that said Letters Patent is hereby corrected as shown below:

Delete Col. 3, line 63 through Col. 4, line 9 and insert therefor:

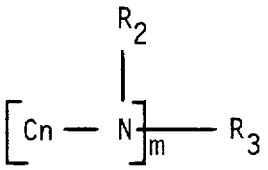

Col. 4, delete lines 41 through 50.

Signed and Sealed this

Twenty-fifth Day of February, 1992

*Attest:*

HARRY F. MANBECK, JR.

*Attesting Officer*

*Commissioner of Patents and Trademarks*